United States Patent [19]

Ericsson

[11] Patent Number: 4,903,592

[45] Date of Patent: Feb. 27, 1990

[54] SILKSCREEN PRINTING SYSTEM FOR MULTICOLOR PRINTING IN A PREDETERMINED ORDER OF COLORS

[75] Inventor: Sylve J. D. Ericsson, Tumba, Sweden

[73] Assignee: Svecia Silkscreen Maskiner AB, Sweden

[21] Appl. No.: 177,382

[22] Filed: Apr. 4, 1988

[30] Foreign Application Priority Data

Apr. 2, 1987 [SE] Sweden ..... 8701392

[51] Int. Cl.[4] ..... B41L 13/02

[52] U.S. Cl. ..... 101/115; 101/126; 101/424.1

[58] Field of Search ..... 101/115, 126, 129, 35, 101/424.1; 198/957, 844, 689.1

[56] References Cited

U.S. PATENT DOCUMENTS

| | | | |
|---|---|---|---|
| 2,359,825 | 10/1944 | Campbell | 101/115 |
| 3,040,657 | 6/1962 | Ichinose | 101/115 |
| 3,329,796 | 7/1967 | Manwaring . | |
| 3,460,470 | 8/1969 | Green et al. | 101/115 |
| 3,812,779 | 5/1974 | Cobb | 101/115 |
| 4,214,522 | 7/1980 | Bille | 101/128.4 |
| 4,221,165 | 9/1980 | Ericsson | 101/126 |
| 4,492,163 | 1/1985 | Ericsson | 101/115 X |
| 4,516,495 | 5/1985 | Ericsson | 101/129 |
| 4,589,335 | 5/1986 | Svantesson | 101/114 |
| 4,610,200 | 9/1986 | Metso | 101/126 |

FOREIGN PATENT DOCUMENTS

| | | | |
|---|---|---|---|
| 1944858 | 6/1969 | Fed. Rep. of Germany . | |
| 1951513 | 4/1971 | Fed. Rep. of Germany | 101/115 |
| 2045728A | 11/1980 | United Kingdom . | |

OTHER PUBLICATIONS

Sparks, "Conveyor & Elevator Belting", pp. 20, 56, 16, printed 1978, PTO receipt date 12/10/79.

*Primary Examiner*—Clifford D. Crowder

*Attorney, Agent, or Firm*—Burns, Doane, Swecker & Mathis

[57] ABSTRACT

A silkscreen printing system for multicolor printing by the application of separate colors in a predetermined order is provided in which a plurality of printing tables are positioned in the path travelled by the print material through the printer arrangement. Each of the print tables cooperates with the respective stencil which is intended to transfer to the print material a single color of the multicolor print. The system also includes a material transporting arrangement for advancing print material to a first of the plurality of print tables so that a first color is applied to the material by the stencil located above the first table. Subsequently, a second printing table receives the print material by the transport of the material transporting means so as to apply a second color print to the print material. The material transporting arrangement extends along all of the plurality of printing tables in the arrangement and is non-electrically conductive. The non-electrical conductive material permits a drying arrangment, operating by electromagnetic waves, to be placed in an area between mutually adjacent printing tables.

2 Claims, 1 Drawing Sheet

SILKSCREEN PRINTING SYSTEM FOR MULTICOLOR PRINTING IN A PREDETERMINED ORDER OF COLORS

TECHNICAL FIELD

The present invention relates to a silkscreen printer arrangement which includes a multiple of printing tables or like support surfaces and which is intended for printing on a single piece of print material in a given order a plurality of colour patterns which form in combination on said material a multicoloured printed pattern.

Silkscreen printers which are intended to apply a plurality of coloured patterns on one and the same print material in a given order normal comprise a plurality of individual printers which are coupled together sequentially and each of which is intended to apply a single colour pattern to the print material.

Thus, a first colour pattern is applied to the print material in a first silkscreen printer, a second colour pattern which is different to the colour of the first pattern printed on the material is then applied to said material in a second silkscreen printer, whereafter the procedure is repeated in subsequent printers until the ultimate multicolour print is obtained.

Normally, it suffices to use four such silkscreen printers connected in series, each of the printers being intended to print a respective colour pattern onto the print material.

The silkscreen printer arrangement according to the present invention is based on the principles utilized in known silkscreen printer arrangements.

The inventive silkscreen printer arrangement utilizes a print material transporting means in the form of an endless conveyor belt which is driven by a drive source in a known manner, such that the belt can be caused to stop in a first position in which the print material is registered in position, whereafter the material is conveyed to a printing position, in which the pattern of a stencil is applied to the material.

The endless conveyor belt or belts and the underlying printing tables are preferably perforated so that the print material can be subjected to a low pressure atmosphere or a high pressure atmosphere engendered beneath the tables and the belt(s).

With the print material subjected to the action of a high pressure atmosphere, such as to reduce friction between the print material and the underlying conveyor belt support surface, the material can be displaced by registering means linearly along said support surface and brought to a registered position, whereafter the high pressure atmosphere can be switched to a low pressure atmosphere, such as to draw the print material against said support surface and increase the friction between the print material and the support surface.

This low pressure atmosphere can be maintained continuously as the print material is conveyed to respective printing positions.

BACKGROUND PRIOR ART

In order to provide a background of the known prior art reference is first made to a silkscreen printer which is intended for applying to print material a first printed pattern consisting of a first colour as described with reference to FIGS. 3 and 4 of the U.S. Patent Specification No. 4,589,335, which is considered equivalent to the content of the Canadian Patent Specification No. 1 197 138.

In the case of this known silkscreen printer, the printing table is carried by a parallel linkage system by means of which the horizontal printing table is moved to a lower position for the movement of gripping means, and to an upper position in which printing of a pattern onto the printing material takes place.

During the time in which the gripping means displaces the print material from the material laying-on position to the printing position on the printing table, the printing table is located in its lower position and the gripping means pass over the printing table along stationary guide means.

However, when the gripping means are located above the printing table in a position for the application of print onto the print material, the printing table is raised to its upper position so that said print can be applied.

The print material is then deposited on the printing table by said gripping means and the printing table is lowered, whereafter the gripping means return to the earlier mentioned position and there collect further print material, at the same time as further gripping means grip the newly printed material, subsequent to raising the printing table.

It is also known in prior art silkscreen printer arrangements to arrange in the transport path of the print material a print material laying-on table, a silkscreen printer, a drying section, a depositing table, a further laying-on table, a further silkscreen printer, a further drying section and a further depositing table, etc., thereby to construct a single printing plant or "line" in which a multicolour print can be applied to a single piece of print material. It will be obvious that such a silkscreen printing line will occupy a large amount of space.

Thus, a silkscreen printer arrangement comprising a plurality of silkscreen printers and intended to apply a multicolour print onto one and the same piece of print material is known from the aforementioned U.S. Patent Specification No. 4,589,335.

The reason why a drying arrangement, which is normally highly space consuming, is required after each silkscreen printer is because the print applied to the print material in one silkscreen printer must be completely dry before further print is applied to the print material in the following silkscreen printer.

It is generally known that printing "wet-inwet" results in poor print quality when printing in silkscreen printers, since the undersurface of respective stencils is brought into contact with the wet print previously applied during a subsequent printing sequence.

Also known to the art are silkscreen printers which are constructed to apply a single colour pattern to print material, and that a plurality of such printers can be arranged in line for the purpose of obtaining a multicolour print.

One known silkscreen printer which can be used advantageously in the silkscreen printer arrangement according to the invention and which can be readily modified for multicolour print purposes is illustrated and described in the British Patent Specification No. 2 045 728.

It will also be noted that various types of drying apparatus are known to the art. One such drying apparatus which can be used advantageously in silkscreen printers, although subsequent to given modification, primarily to the printer, is one by means of which water based inks or pastes can be dried by means of electromagnetic waves at radio frequency. An example of one such drying apparatus is found illustrated and described in the U.S. Patent Specification No. 3,329,796.

It can also be mentioned that the U.S. Patent Specification No. 4,516,495 teaches, inter alia, a method of sensing the prevailing position of print material or print on the printing table, thereby enabling any discrepancies from a set-point value to be established, so that the position of a stencil frame can be adjusted towards this set-point value prior to transferring the stencil print onto the print material.

SUMMARY OF THE PRESENT INVENTION

Technical Problems

When considering the present state of the prior art as described above, and when considering that strenuous efforts have been made over a long period of time to provide a silkscreen printer arrangement in which a plurality of colour patterns can be applied in a given order to a single piece of print material in order to obtain a multicolour print, it will be seen that a technical problem resides in the realization that one silkscreen printer of known construction among a plurality of silkscreen printers operating in accordance with mutually different principles, can be utilized advantageously to produce such multicoloured prints.

It will also be seen that a technical problem resides in complementing, with the aid of simple means, or solely extending an endless conveyor belt intended for a silkscreen printer, such that the endless conveyor belt can be utilized for a plurality of series-connected, preferably four series-connected, silkscreen printers, while still enabling print material which is to receive a plurality of printed patterns to be brought to a precisely registered position on each respective printing table, and while utilizing a single common conveyor belt, since precise registration of one and the same print material at different printing tables must appear to be impossible when the material is transported stepwise on elastic plastic or rubber belts.

It will also be seen that a further technical problem resides in extending the print material transporting means by means of which the print material is carried through the printer in a manner which will enable the transporting means to serve one, two or more similar silkscreen printers.

Another technical problem resides in the ability of connecting together two or more silkscreen printers, with the aid of relatively simple means, such as to leave between mutually adjacent printers a space which will accommodate a drying apparatus by means of which thick colour print and wide printed areas can be dried rapidly.

A more qualified technical problem in this regard resides in the exchange of one material transporting means of a first silkscreen printer intended for applying a particular print to said print material, and a corresponding material transporting means of an adjacent, similar silkscreen printer, with one single, extended material transporting means while still providing an intermediate space for accommodating electrical drying appliances.

When desiring to install drying apparatus in the space between two closely adjacent silkscreen printers, a technical problem resides in selecting, from among all available drying apparatus, a drying apparatus which has a very short longitudinal extension in the direction of travel of the print material and which will afford an energy consumption essentially adapted to prevailing and momentary loads, i.e. momentary drying requirements with regard to ink thickness and the area of wet print to be dried.

A further technical problem resides in the selection of drying apparatus which is constructed so as not to require a heating-up period, and which will commence to dry immediately and automatically when the need arises, uniformly throughout the ink thickness and over the whole area of the wet print applied.

A further technical problem resides in the selection of a drying apparatus which requires a low power input and which is so effective as to be capable of drying the wet print during the relatively short length of travel available, without heating the print material to any appreciable extent.

Another technical problem resides in the selection of an effective, low-power drying apparatus suitable for the aforesaid purpose and for the aforesaid application, which will dry water-based inks or pastes uniformly irrespective of where the water-based print is placed on the print material.

A further technical problem resides in the selection of drying apparatus which is particularly suited for drying water-based inks or pastes, thereby to reduce or eliminate environmentally harmful products generated during the drying process.

It must also be considered a technical problem to provide, with the aid of simple means, conditions such that the printer components which, of necessity, are displaced linearly over or extend across the space between two mutually adjacent silkscreen printers can be constructed so as not to impair in any way the drying effect of the drying apparatus while still ensuring a good fit and precise registration of the print material on respective printing tables throughout the whole of the silkscreen printer arrangement used.

SOLUTION

The present invention relates to a silkscreen printer arrangement in which a plurality of colour prints can be applied in a given order onto a single piece of print material in a manner to create thereon a multicoloured print.

The invention is based on the principle of "extending" a known silkscreen printer by incorporating in said printer arrangement a multiple of printing tables which are positioned in the path travelled by the print material through the printer arrangement and each of which printing tables cooperates with a respective stencil which is intended to transfer to the print material one single-colour pattern of said multicolour print, and which printer arrangement further includes a print material transporting means which is intended to advance print material first to a first printing table, where said first colour print is applied to said print material by the stencil located above said first table, and then to a second printing table, where a second colour print forming part of said ultimate multicolour print is applied to the print material by the stencil located above said second table, and so on.

The silkscreen printer arrangement according to the present invention is primarily characterized in that the material transporting means extends along all of the printing tables in said printer arrangement; in that the material transporting means is constructed from a material which is not electrically conductive; and in that a drying arrangement or apparatus which operates with electromagnetic waves is located in an area provided between mutually adjacent printing tables.

In accordance with one advantageous embodiment of the invention, the print material transporting means comprises a plastic or rubber fabric. The plastic or rubber fabric of the transporting means and respective printing tables located therebeneath are perforated so that an atmosphere of high pressure or an atmosphere of low pressure is able to act on the print material carried by said transporting fabric, the low pressure atmosphere creating suction conditions which hold the print material firmly against the plastic or rubber transporting fabric.

According to another embodiment of the invention, the print material transporting means may comprise a plurality of plastic or rubber belts arranged in mutual parallel spaced relationship. The belts may be perforated or perforations may be provided solely in the supporting surface of the printing table.

A particular advantage is afforded when there is used a drying arrangement which works at a radio frequency of from 10 MHz to 100 MHz or at higher radio frequencies. It is also preferred that a drying arrangement for drying newly applied single-colour prints is provided in each space between mutually adjacent printing tables.

When the print material transporting means comprises one or more resilient belts it has been found particularly advantageous to enable the print material to be brought to a registered position separately at each printing table, so that the stencil pattern can be correctly applied to intended parts of the print material.

It is also proposed in accordance with the invention that a drying arrangement operating at a radio frequency of between 30–60 MHz is located between mutually adjacent printing tables and after the last printing table in line.

Finally, in accordance with a further embodiment of the invention, means are provided for evaluating the position of the print material on respective printing tables and also means for displacing respective stencils, in response to established discrepancies, to a position in which the stencil pattern will be transferred correctly to intended parts of the print material.

ADVANTAGES

Those advantages primarily afforded by an inventive silkscreen printer arrangement reside in the provision of possibilities of applying to print material a multiple of single-colour print patterns in a given order so as to achieve a multicolour print while drying the single-colour prints between each printing sequence.

BRIEF DESCRIPTION OF THE DRAWINGS

An embodiment of a silkscreen printer arrangement at present preferred for applying a multiple of colour prints onto a single print material in a given order in a manner to create a multicoloured print will now be described in more detail with reference to the accompanying drawings, in which.

DESCRIPTION OF EMBODIMENTS AT PRESENT PREFERRED

Figure 1:
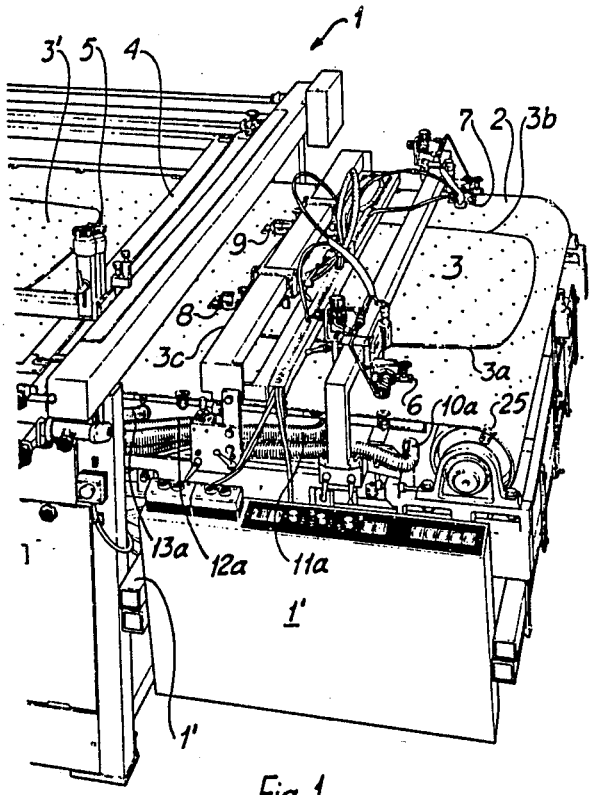
FIG. 1 is a perspective view of part of a silkscreen printer provided with an endless conveyor belt which can be extended in a simple manner for use in a plurality of series-connected silkscreen printers.

FIG. 1 illustrates in perspective an earlier known silkscreen printer which is provided with a material transporting device in the form of an endless conveyor belt which serves to support the material which is to receive print.

The silkscreen printer is generally referenced 1 in FIG. 1 and since persons skilled in this art will be well acquainted with the method in which such printers operate, only those parts of the printer of which knowledge is required in order to obtain an understanding of the significant features of the invention will be described here.

The endless conveyor belt is referenced 2 and is effective in transporting the material which is to receive print, i.e. print material.

Resting on the conveyor belt 2 is a print material 3 which is in the form of a thin glass plate and which, by linear displacement, is intended to be brought to a first registered position in relation to the frame 1' of the printer 1.

Although not shown, the conveyor belt 2 is driven by a d. c. motor. The d.c. motor is controlled by a four-quadrant thyristor control device which is controlled so as to first stop the conveyor belt in a first position for registration of the print material 3 in the aforesaid first registered position illustrated in FIG. 1, and there to move the belt and therewith the material 3 to the printing position. The illustration of FIG. 1 shows a preceding print material 3' located in this second registered position.

A print corresponding to the pattern of a stencil is applied directly to the print material in the printing position.

For the sake of clarity, the stencil has not been shown in FIG. 1, although it can be mentioned here that the stencil is stretched in a frame 4 in a known manner. Ink deposited on the stencil is pressed through perforations provided therein with the aid of a squeegee arrangement 5, such as to apply print to the material 3' located in the printing position. It will be understood that the position of the stencil and the print material must be related exactly to one another.

Since the stencil 4 is stationary in relation to the printer frame or stand, it will be obvious that the position of the print material is of uttermost importance in achieving a precisely related print to a tolerance of some tenths of a millimeter.

This is not possible with present day silkscreen printers, and in order to provide a printer which is capable of producing a multicolour print on one and the same piece of print material, other means must be employed.

When occupying its first registered position according to FIG. 1, the print material 3 is acted upon from beneath by a fluid (air) so as to reduce friction between the print material and the conveyor belt 2 supporting said material. This facilitates linear displacement of the print material 3 by material registering means 6, which co-act with the side edges **3*a* of the material, and by material registering means 7, which co-act with the side edges 3*b* of said material. Material registering means 8, 9 are provided for co-action with the leading edge of the print material. The print material 3** can be displaced linearly by the registering means 6, 7, 8 and 9 to a precisely registered position with only insignificant friction between the print material 3 and the opposing surface of the conveyor belt 2. Just how much friction there should be between the material and the opposing conveyor belt surface in order to achieve satisfactory registration of the print material can be evaluated in practice from material to material, by increasing or decreasing the amount of fluid beneath the material.

Subsequent to having been registered in its first registered position by the registering means 6, 7, 8 and 9, it is necessary to increase the frictional force acting between the material 3 and the opposing support surface of the conveyor belt 2. This is achieved through the agency of a region of low pressure which acts on the print material from beneath. This region of low pressure, or a similar region of low pressure, extends along the whole of the path travelled by the print material from the first registered position to the printing position, and the suction force engendered by said low pressure is maintained during the actual printing operation.

Arranged beneath the conveyor belt 2 is a support surface or printing table which is divided into sections. The conveyor belt 2 is perforated and extends across the full width of the printing table, which is also provided with perforations.

The underpart of the printing table is divided into sections and each section is intended to cooperate with hoses or pipes 10*a*, 11*a*, 12*a* which are connected to a pressure control valve (not shown), for controlling the respective regions of high and low pressure.

Figure 2:
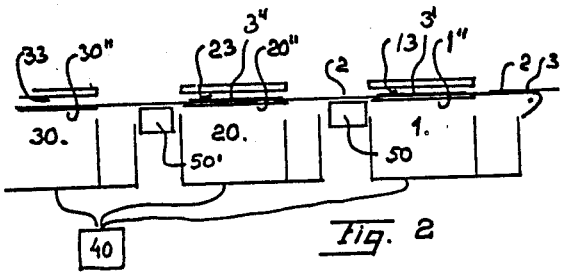
FIG. 2 illustrates the principle of mutually connecting in series three silkscreen printers placed in line, one after the other.

FIG. 2 illustrates schematically an arrangement of three silkscreen printers of essentially the same kind as that illustrated in FIG. 1, which are positioned in line one after the other. These printers are referenced 1, 20 and 30 respectively.

In accordance with the invention the illustrated silkscreen printers 1, 20 and 30 are similar in function but slightly different in construction, insomuch that solely one single conveyor belt 2 is used, this belt being constructed to pass over all of the printing tables located in respective printers.

As will be understood, the silkscreen printers 1, 20 and 30 are mutually synchronized through an automotive or central processor 40, so that a print is applied to each print material simultaneously in respective printers.

Although the example shown in FIG. 2 only compries three serially coupled printers, it will be obvious that any desired number of printers may be connected up in series. Preferably, four such printers are connected one behind the other, so as to enable a multicolour print to be applied.

The silkscreen printers illustrated schematically in FIG. 2 are thus intended for applying a multiple of colour patterns to the print material 3 in a given ordered sequence, such as ultimately to provide the print material with a complete multicolour pattern.

The term "ink" as used in the present document shall not only be interpreted as referring to the various types of inks and pastes commonly used in silkscreen printers, but shall also be understood to refer to a single ink or paste which has been given different colours.

In this regard, the illustrated silkscreen printer arrangement includes a plurality of printing tables which are arranged along the path travelled by the print material 3 through the printers. The first of these tables is referenced 1", the second 20" and the third 30".

It will be understood that although only three sequentially arranged printing tables are included in the illustrated embodiment, the number of tables provided will correspond to the number of colours required, and also possibly an additional table for clear varnishing purposes.

Consequently, four sequentially arranged printing tables are normally used with a conveyor belt or like transporter which is common to all tables, as previously mentioned.

It is shown in FIG. 2 that the invention can be applied in a particularly simple fashion when a plurality of essentially complete silkscreen printers are arranged in spaced relationship in a straight line.

Such an arrangement will obviate the need of connecting together the print material gripping systems of respective printers, since the endless conveyor belt 2 or equivalent transporter, extends past all of the printing tables present. It will be obvious, however, that minor constructional changes must be made and that a common guide means must be provided in order to synchronize the working cycles of respective printers. There is nothing which prevents certain parts of the drive machinery of respective printers from being replaced with a single drive means.

Each of the horizontal tables is positioned beneath a respective stencil for cooperation therewith, the table 1" thus cooperating with a stencil 13, the table 20" with a stencil 23, and the table 30" with a stencil 33, each of said stencils being stretched in a respective frame 4 (FIG. 1). The stencil frames are stationary in relation to the printer chassis.

The stencil 13 is provided with a first pattern which corresponds solely to a single first colour among the multiple of colours included in a complete multicolour print. The stencil 23 exhibits a second pattern which corresponds to a second of the colours in said multicolour print, while remaining stencils each correspond to the remaining colours of said print.

The inventive silkscreen printer arrangement thus utilizes only one single print material transporter, which transports the print material 3 to the first printing table 1", where the first colour pattern on the stencil 13 is applied to the print material, and from there to the second printing table 20", where the second colour pattern on the stencil 23 is applied to said material, this procedure being repeated with all printing tables until the complete pattern has been applied.

Subsequent to applying the full multicolour print to the material 3, by applying a first pattern to the material on the printing table 1", a second pattern on the printing table 20", a third pattern on the printing table 30", etc., with the last pattern of the multicolour print being applied on the last printing table in line, the print material is moved by the conveyor belt 2 to a depositing table, not shown, which lies in the plane of the conveying surface.

As will be understood, in addition to including facilities which enable the printing material to be positioned with extreme precision on the respective printing tables 1", 20", 30" of the illustrated printer arrangement, it is necessary to ensure that the printing ink or paste used in the application of one pattern of the multicolour print has dried completely, before applying the pattern of the next stencil in line, so that a precisely defined multicolour print is obtained.

In order to achieve precise registration of the print material on the printing table 1" and on the subsequent printing tables 20", 30", it is proposed that the stencil 13 and particularly the following stencils 23, 33 are registered and the positions of said stencils adjusted in the manner illustrated and described in U.S. Patent Specification Ser. No. 4,516,495.

It is particularly proposed that the recommendations whereby the stencil frame is arranged for linear displacement relative to the printer chassis are followed, such that the stencil can be brought to a precise position above the print material and the stencil pattern consequently applied accurately on desired parts of the print material.

In accordance with one advantageous embodiment of the invention, the silkscreen printer arrangement incorporates a facility which enables a water-based wet print to be dried before applying further print to the print material. For example, a drying section of short length may be inserted between mutually adjacent printing tables in the transport direction of the print material. This is illustrated in FIG. 2 by drying sections 50 and 50' located between mutually adjacent tables, and also adjacent the last printing table in the line, these drying sections ensuring that a print applied on one printing table will always be dry before printing is commenced at the next printing table.

The ink used in this case is preferably water based. The drying sections may then be constructed to operate with electromagnetic waves of radio frequency.

As will be understood, when the drying sections operate with electromagnetic waves at radio frequencies, no part which is located in the vicinity of the drying sections may consist of an electrically conductive material or be electrically conductive.

Consequently, only the conveyor belt 2 of the transporter may extend between mutually adjacent silkscreen printers and their respective printing tables.

A suitable drying section for use in the present context is described and illustrated in U.S. Patent Specification Ser. No. 3 329 796.

As will be understood from the aforedescribed embodiment of the invention pieces of print material 3, 3' are transported in mutually spaced relationship through the printer arrangement, with the distances between respective print material being adapted to the distances between respective printing tables, and that a print is applied simultaneously to all print material located beneath a respective stencil in all printers.

Subsequent to ensuring that all print material is positioned correctly and that the stencil frames have been adjusted to their correct printing positions, all of the printers are activated simultaneously from the central control means, so as to apply print simultaneously to all print material present.

Subsequent hereto, the central control unit causes the transporter to move the print material stepwise to the next printing table in line, where the next pattern is printed onto the material, during which transporter movement the print applied is dried in a respective drying section as before described.

Since the central control unit used can be constructed readily by those skilled in the art, without requiring work of an inventive nature, the control unit will not be described in detail here.

It will also be understood from the aforegoing that the aforesaid region of low pressure is effective in holding the print material firmly against a respective printing table, at least prior to and during a printing operation.

It is further emphasized that in the case of a drying section of the aforesaid kind, no electrically conductive component or part may extend into the region where drying is effected, and hence the material transporting means must be constructed accordingly with this in mind.

It will be understood that the invention is not restricted to the aforedescribed exemplifying embodiment and that modifications can be made within the scope of the following claims.

It should be noted by the expression pattern is also meant solely a colour transfer.

I claim:

1. A silkscreen printer arrangement for applying a multiple of color patterns in a given order onto print material such as to obtain a multicolored printed pattern thereon, the printer arrangement includes a multiple of printing tables which are positioned in the path travelled by the print material through the printer arrangement and each of which tables cooperates with a respective stencil to transfer to said print material one single color pattern of said multicolor print, and further includes a material transporting means to advance print material firstly to a first printing table, where said first color print is applied to said material by the stencil located above said first table, and then to a second printing table, where a second color print forming part of said multicolor print is applied to the material by the stencil located above said second table, wherein said material transporting means extends along all of the printing tables in said printer arrangement; said material transporting means is constructed from a material which is not electrically conductive and has a nonelectrically conductive conveying surface perforated with holes through which a region of low pressure and high pressure can act on the print material located on said surface, said high pressure acting through the conveying surface to reduce friction between the print material and the conveying surface so as to facilitate linear displacement of the print material, said low pressure acting through the conveying surface to increase friction between the print material and the conveying surface so as to securely position the print material when said color is applied to the print material; a drying arrangement which operates with electromagnetic waves at a radio frequency of from 10–100 MHz is located in an area provided between mutually adjacent printing tables; and including means for evaluating position of the print material on the printing tables; and means for adjusting said respective stencil, in response to sensed discrepancies in the stencil location, to a position in which the stencil pattern will be transferred to the print material at a predetermined part.

2. A printer arrangement according to claim 1, characterized in that the printing tables are in mutually spaced relationship and that a drying arrangement is located in the respective spaces between mutually adjacent printing tables, such as to dry newly applied print during passage of the material past said drying arrangements.

* * * * *